United States Patent [19]

Frazer

[11] Patent Number: 4,544,085

[45] Date of Patent: Oct. 1, 1985

[54] PUMP TYPE DISPENSER FOR HEAT SOFTENABLE FOOD PRODUCTS

[75] Inventor: John M. Frazer, Machesney Park, Ill.

[73] Assignee: Taylor Freezer Company, Rockton, Ill.

[21] Appl. No.: 507,013

[22] Filed: Jun. 22, 1983

[51] Int. Cl.[4] ..... B67D 5/62

[52] U.S. Cl. ..... 222/146.4; 222/146.5

[58] Field of Search ..... 222/146.2, 146.4, 146.5; 239/135, 136, 139; 425/549, 551; 165/47 H, DIG. 12

[56] References Cited

U.S. PATENT DOCUMENTS

| | | | |
|---|---|---|---|
| 4,094,446 | 6/1978 | Brutsman | 222/146.5 |
| 4,121,740 | 10/1978 | Gabrys | 222/146.2 |
| 4,125,352 | 11/1978 | Gellert | 425/549 X |
| 4,389,002 | 6/1983 | Deuellian et al. | 222/146.4 |

FOREIGN PATENT DOCUMENTS

| | | | |
|---|---|---|---|
| 487434 | 6/1938 | United Kingdom | 222/146.4 |

*Primary Examiner*—Charles A. Marmor

*Attorney, Agent, or Firm*—Vernon J. Pillote

[57] ABSTRACT

A pump-type dispenser for heat softenable food products including a product receptacle and a heater for heating the product in the receptacle to a predetermined product softening temperature range at which the product is heat softened to a pumpable condition. A product pump extends downwardly into the receptacle to receive product therefrom and has a spout disposed externally of the receptacle. A closed heat pipe containing a vaporizable heat transfer fluid has its upper condensation zone in heat exchange relation with the spout and its lower evaporation zone arranged to receive heat from the heater.

7 Claims, 4 Drawing Figures

Fig. 1.
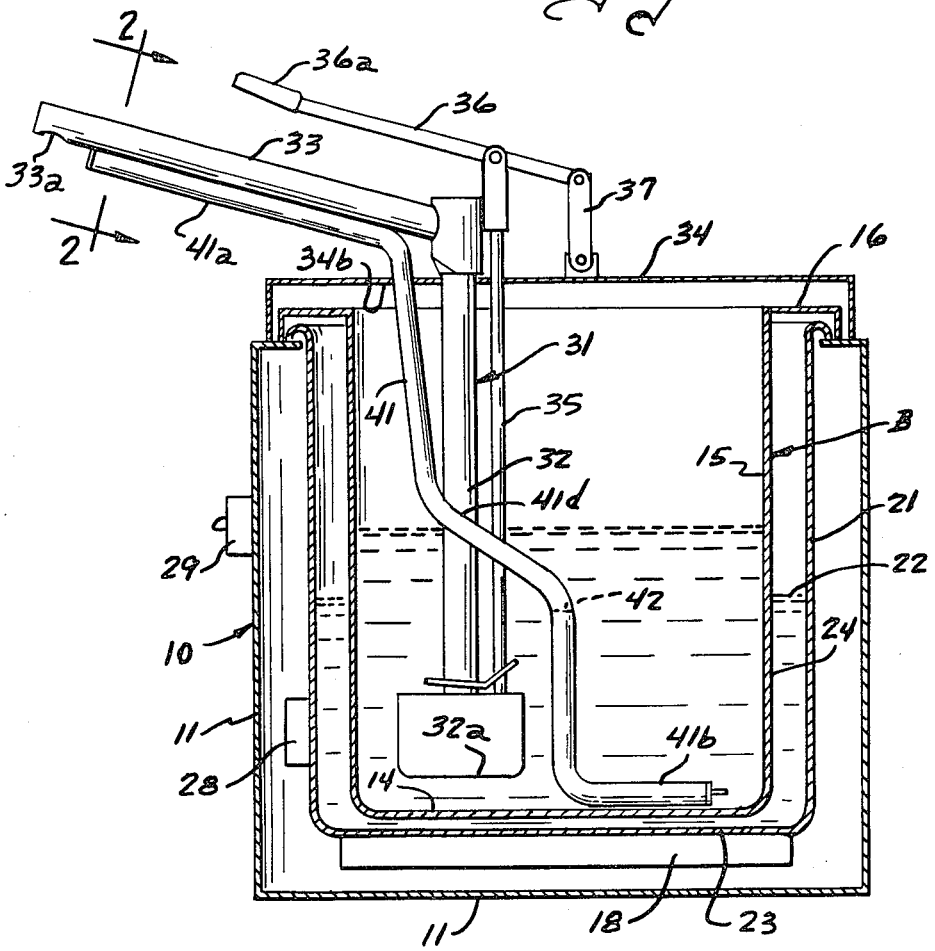
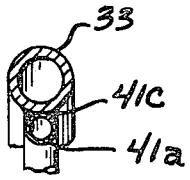
Fig. 2.

Fig. 3.
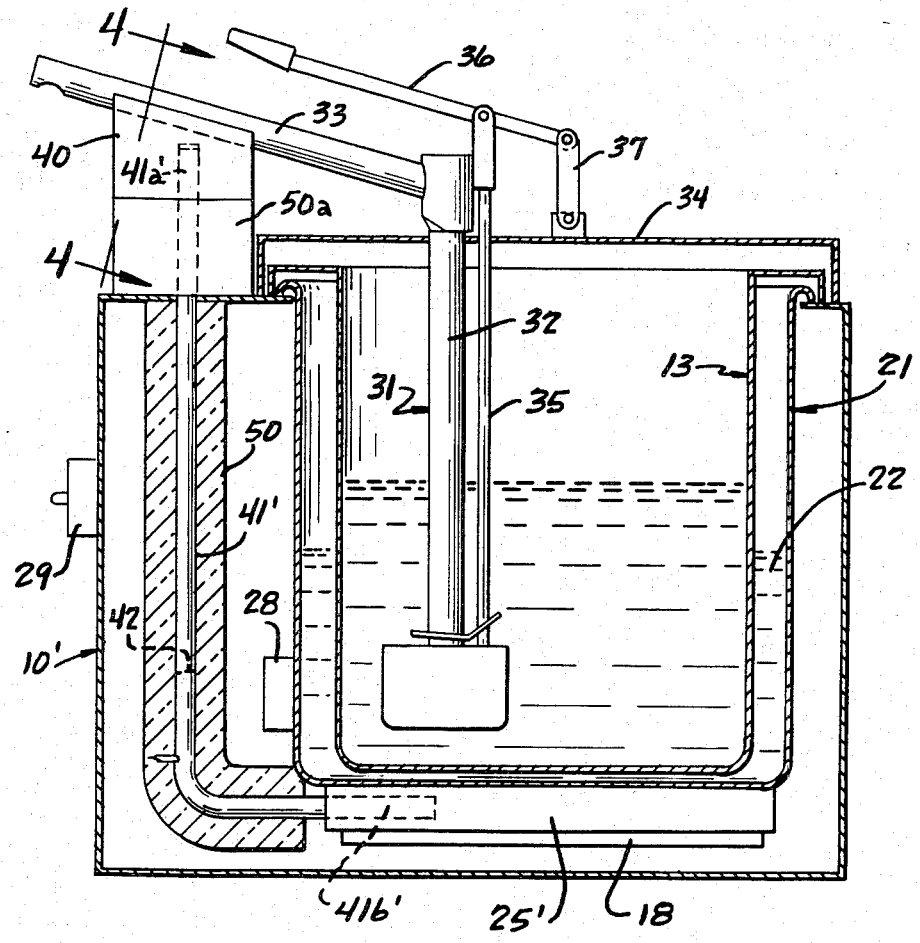
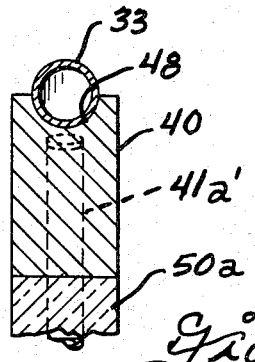
Fig. 4.

PUMP TYPE DISPENSER FOR HEAT SOFTENABLE FOOD PRODUCTS

It is well known to provide pump-type dispensers for dispensing measured quantities of various different liquid and semi-liquid food products. Some of these food products such as some of the syrup and ice cream toppings are very viscous at normal room temperatures and it is common practice to provide heaters for heating the product in the product receptacle to maintain it in a heat softened and pumpable condition. The dispensing pumps extend down into the product in the receptacle and in general are heated by the product. However, the spout of the pump must extend outside the receptacle and problems have been encountered in maintaining the product in the spout in a heat softened condition.

U.S. Pat. No. 4,094,446 discloses a pump-type dispenser having a main heater for heating the product in the product receptacle and an auxiliary heater for heating a saddle located externally of the receptacle and arranged to contact the spout. Problems have been encountered in the field with electrically operated spout heaters of the type disclosed in U.S. Pat. No. 4,094,446. The auxiliary heater for the spout has been found to burn out at a much higher rate than the main heater used for heating the product reservoir and this has not only increased the cost of maintenance of the dispensers, but also frequently presented some shock hazard when the external auxiliary spout heater burned out. Further, some problems were encountered in reliably heating the spout at a temperature sufficient to maintain the product in a heat softenable condition. Heat exchange between the spout heater and spout is dependent on the area of contact between the heater and spout and this contact area could vary dependent on the care with which the spout was positioned in the saddle, when the pump was reinstalled in the reservoir. Sometimes only a line or even a point contact occurred between the spout and saddle and this not only reduced heating of the spout but also contributed to overheating of the auxiliary heater for the saddle.

SUMMARY OF THE INVENTION

It is an object of the present invention to provide a pump-type dispenser for heat softenable food products having an improved arrangement for heating the pump spout to maintain the product in a heat softened condition, and which avoids the burn-out and electrical shock problems encountered in the prior electrically operated spout heaters.

Another object of this invention is to provide a pump-type dispenser for heat softenable food products in which heat is transferred to the spout from the same heater that is used to heat the product reservoir in a manner to maintain the spout temperature correlative with the temperature of the product in the reservoir.

Still another object of this invention is to provide a pump-type dispenser for heat softenable food products in which the heating of the spout is not dependent on precise positioning of the pump and spout.

Accordingly, the present invention provides a pump-type dispenser for heat softenable products including a product receptacle and heater for heating the product in the receptacle and means for controlling the heater to heat the product in the receptacle to a predetermined product softening temperature range in which the product is in a heat softenable condition. Pump means are detachably mounted on the receptacle and include a pump body extending downwardly in the receptacle to receive product therefrom and a dispensing spout external of the receptacle for delivering product. A closed heat pipe containing a vaporizable heat transfer fluid has its upper condensation zone in heat exchange relation with at least a portion of the spout and a lower evaporation zone arranged to receive heat from the heater. The type and charge of vaporizable heat transfer fluid in the closed heat pipe is selected such that, at least at the lower portion of the predetermined product softening temperature range, a portion of the heat transfer fluid is in a liquid state and a portion is in the vapor state whereby, when the lower evaporization zone of the heat pipe receives heat from the heater, some of the liquid heat transfer fluid in the lower evaporization zone is vaporized and vapors rise and condense in the upper condensation zone to heat the spout when the spout temperature is below the temperature of the evaporization zone.

These, together with other objects, features and advantages of this invention will become apparent for the following description when taken in connection with the accompanying drawings wherein:

FIG. 1 is a vertical sectional view through a preferred embodiment of pump-type dispenser for heat sofenable food products;

FIG. 2 is a transverse sectional view taken on the plane 2—2 of FIG. 1;

FIG. 3 is a vertical sectional view through a modified form of pump-type dispenser for heat softenable food products; and FIG. 4 is a fragmentary transverse sectional view taken on the plane 4—4 of FIG. 3.

The embodiments of FIGS. 1 and 2 is the presently preferred embodiment of the invention. In this embodiment, the pump-type dispenser for heat softenable products includes a stationary outer housing 10 having a bottom wall 11 and upstanding side and end walls 12. A product receptacle 13 is mounted in the outer housing and is preferably removable therefrom to facilitate cleaning. As shown in FIG. 1, the product receptacle includes a bottom wall 14 and upstanding side walls 15 and has a peripheral flange 16 at its upper end removably supported on the stationary housing. An electrical heater 18 is provided in the housing for heating the product in the product receptacle and, in order to improve transfer and distribution of heat from the heater to the product in the product receptacle, an outer receptacle 21 is provided in the housing externally of the product receptacle and adapted to receive a heat transfer liquid 22 such as water or the like. The outer receptacle 21 has a bottom wall 23 and upstanding side walls 24 and the product receptacle and outer receptacle are dimensioned and supported so that the bottom and side walls of the product receptacle are spaced from the bottom and side walls of the outer receptacle to provide a chamber therebetween for reception of the heat transfer liquid. The heater 18 is preferably of the plate or strip type and is disposed in contact with the bottom wall 23 of the outer receptacle to provide good heat transfer between the heater and the bottom wall of the outer receptacle. Thus, heat applied to the bottom wall 23 of the outer receptacle is transferred through the heat transfer liquid 22 to the product receptacle 13 to heat the product P in the product receptacle. The heat transfer liquid not only aids in the transfer of heat to the bottom and side walls of the inner receptacle, but also helps avoid excessive heating of the bottom wall of the inner receptacle which could adversely affect the composition or flavor of the product P. A temperature control means such as a thermostat 28 is electrically connected in a circuit with a manually operable control switch 29 to the heater 18 and the thermostat is arranged to control the heater in a manner to cause the heater to heat the product to a predetermined product softening temperature range in which the product is heat softened to a pumpable condition. In the embodiment shown, the thermostat is mounted on the outer receptacle 21. The product P is relatively viscous, particularly at lower temperatures, and it will heat much more slowly than the outer receptacle 21 and the heat transfer liquid 22. However, the temperature controller or thermostat will operate to turn the heater 18 on and off in a manner to prevent heating of the heat transfer liquid 22, to a temperature above the desired product softening temperature range until the product receptacle and the product P are heated up to the desired product softening temperature range. For example, for many dessert toppings, syrups, hot fudge, and the like, a temperature in the range of 110 to 120 degrees F. is suitable.

A dispensing pump 31 is detachably mounted so that it can be installed on and removed from the product receptacle 13. The dispenser pump is of conventional construction and includes a pump body 32 that extends downwardly into the product receptacle with its inlet end 32*a* disposed adjacent the bottom of the product receptacle, and a spout 33 extending externally of the receptacle and having an outlet 33*a* at its end for delivering product from the pump. The pump is preferably attached to a cover 34 for the product receptacle for support thereby and the pump has an operating rod 35 that is connected to a hand operated lever 36. The lever is herein shown connected at one end through a link 37 to the cover 34 and is pivotally connected intermediate its ends to the rod 35 to operate the pump when the handle portion 36*a* of the lever 36 is depressed. As is conventional, such dispensing pumps are arranged to dispense a measured quantity of product each time the operating lever is actuated.

When the product P is heated to a product softening temperature, it also heats the pump body that is immersed therein and this maintains the product in the pump body in a heat softenable condition. However, the spout 33 is disposed externally of the receptacle and is cooled by the ambient temperature and problems have been encountered in maintaining the product in the spout in a heat softened flowable condition. In accordance with the present invention, the spout is heated by a closed heat pipe 41 containing a vaporizable heat transfer fluid. The heat pipe has an upper condensation zone 41*a* in heat exchanger relation with at least a portion of the spout and a lower evaporation zone 41*b* arranged to receive heat from the heater 18. In the embodiment of FIGS. 1 and 2, the upper condensation zone 41*a* is fixed to the spout and is preferably brazed to the spout as indicated at 41*c* in FIG. 2, along a length of the spout to provide good heat transfer between the condensation zone and the spout. The heat pipe extends downwardly through an opening 34*b* in the cover 34 and into the product in the receptacle and the opening is preferably made sufficiently large to avoid direct contact between the cover and the heat pipe. In this embodiment the lower evaporization zone of the heat tube receives heat from the heater indirectly through the outer receptacle 21, heat exchange liquid 22, product receptacle 15 and the product P. The product is quite viscous and does not transmit heat rapidly and, preferably, the lower evaporization zone 41*b* is arranged to extend closely adjacent the bottom wall 23 of the inner recpetacle. The heat pipe is removable as a unit with the pump and cover and the heat pipe may conveniently be secured as by brazing to the pump body 32 at a location 41*d* intermediate its upper condensation zone and the lower evaporization zone, to stabilize and support the heat pipe.

The type and the charge of the vaporizable heat transfer fluid 42 in the heat pipe is selected such that, at least at the lower portion of the product softening temperature range, a portion of the heat transfer fluid is in the liquid state and a portion is in the vapor state. Thus, when the lower evaporation zone of the heat pipe receives heat from the heater 18, some of the liquid heat transfer fluid in the lower evaporation zone is vaporized and the vapors rise and condense in the upper condensing zone to heat the spout when the spout temperature is below the temperature of the heat pipe evaporation zone. In view of its use in connection with foodstuffs, the heat transfer fluid is preferably of a non-posionous and non-toxic type and, in order to reduce the likelihood of leakage and rupture of the heat pipe, the heat transfer medium is also preferably selected as one which will liquify at a moderate pressure. For example, the heat transfer fluid can be a refrigerant such as refrigerants marketed under the trademark "Freon". Freon 11 has a condensation pressure of about 18 psig at 120 degrees F.

A modified form of pump-type dispenser is illustrated in the embodiment of FIGS. 3 and 4, the dispensing of FIGS. 3 and 4 has a number of parts the same as those described in connection with the previous embodiment and like numerals are used to designate the corresponding parts and like numerals followed by the postscript ′ are used to designate modified parts. In general, this embodiment includes a product receptacle 13, an outer receptacle 21 that has its side and bottom walls spaced from the product receptacle to receive a heat transfer liquid 22 such as water, and a heater 18 for heating the outer receptacle under the control of a thermostat 28 and manually operated switch 29. As in the preceding embodiment, a product pump 31 has a pump body 32 extending downwardly into the product receptacle and a spout 33 extending externally of the receptacle and the product pump is mounted on a cover 34 for support thereby and for removal as a unit therewith. The pump has an operating rod 35 operated by a manually operable lever 36 connected by a link 37 to the cover.

In the embodiment of FIGS. 3 and 4, a closed heat pipe 41′ containing a vaporizable heat transfer fluid is mounted on the stationary housing 10′ externally of the product receptacle. The heat pipe 41′ has an upper condensation zone 41*a′* fixed to a thermally conductive member 40 that is located and arranged to contact the spout 33 in heat conductive relation therewith. Thus, the thermally conductive member 40 has a recess or groove 48 for receiving a portion of the spout 33, to provide heat transfer between the spout and thermally conductive member, while allowing the pump and its spout to be installed and removed as a unit from the receptacle. The heat pipe 41′ has a lower evaporation zone 41*b′* in fixed heat conductive relation with a second thermally conductive member such as a plate 25′ that is heated by the heater 18. The portion of the heat pipe 41′ between the evaporation zone and the top of the housing 10' is preferably thermally insulated as indicated at 50, and the portion of the heat pipe externally of the housing and below the thermally conductive member is preferably insulated as by an insulating block 50*a*. Thus, in the embodiment of FIGS. 3 and 4, the evaporation zone of the heat pipe is heated more directly by the heater 18. However, heat transfer between the upper condensation zone 41*a'* and the spout is dependent on the contact between the spout and the thermally conductive member 40.

From the foregoing it is thought that the construction and operation of the dispenser for heat softenable food products will be readily understood. The product in the product receptacle is heated by the heater 18 under the control of a temperature controller 28 to a predetermined product softening temperature range. The pump body is immersed in the product and is heated thereby to maintain the product in the pump in a heat softened condition. The heat pipe containing a vaporizable transfer fluid has its upper condensation zone in heat transfer relation with the spout and its lower evaporation zone arranged to receive heat from the heater. Thus, the vaporizable heat transfer liquid in the heat pipe is vaporized by the heat from the heater in the lower evaporization zone and the vapors rise in the heat pipe and condense in the upper condensation zone to transfer the heat of condensation to the spout. With this arrangement, the spout will be heated at a temperature closely approximating the temperature to which the product in the receptacle is heated by the heater under the control of the thermostat 28.

The embodiments of the invention in which an exclusive property or privilege is claimed are defined as follows:

1. A pump-type dispenser for heat softenable food products comprising, a product receptacle, heater means for heating the product in the receptacle and means for controlling the heater means to heat the product in the receptacle to a predetermined product softening temperature range at which the product is heat softened to a pumpable condition, pump means detachable from the receptacle and including a pump body extending downwardly in the receptacle to receive product and a dispensing spout external of the receptacle for delivering product, a closed heat pipe containing a vaporizable heat transfer fluid and having an upper condensation zone in heat exchange relation with at least a portion of the spout and a lower evaporation zone arranged to receive heat from said heater means, the type and charge of vaporizable heat transfer fluid in the closed heat pipe being selected such that, at least at the lower portion of said predetermined product softening temperature range, a portion of the heat transfer fluid is in the liquid state and a portion in the vapor state whereby, when the lower evaporization zone of the heat pipe receives heat from the heater means, some of the liquid heat transfer fluid in the lower evaporization zone is vaporized and the vapors rise and condense in the upper condensation zone to heat the spout when the spout temperature is below temperature of the evaporization zone, the heat pipe extending downwardly inside the receptacle to position the lower evaporization zone below the product level to receive heat when the product is heated by the heater means.

2. A pump-type dispenser for heat softenable food products comprising, a product receptacle, heater means for heating the product in the receptacle and means for controlling the heater means to heat the product in the receptacle to a predetermined product softening temperature range at which the product is heat softened to a pumpable condition, pump means detachable from the receptacle and including a pump body extending downwardly in the receptacle to receive product and a dispensing spout external of the receptacle for delivering product, a closed heat pipe containing a vaporizable heat transfer fluid and having an upper condensation zone in heat exchange relation with at least a portion of the spout and a lower evaporation zone arranged to receive heat from said heater means, the type and charge of vaporizable heat transfer fluid in the closed heat pipe being selected such that, at least at the lower portion of said predetermined product softening temperature range, a portion of the heat transfer fluid is in the liquid state and a portion in the vapor state whereby, when the lower evaporization zone of the heat pipe receives heat from the heater means, some of the liquid heat transfer fluid in the lower evaporization zone is vaporized and the vapors rise and condense in the upper condensation zone to heat the spout when the spout temperature is below temperature of the evaporization zone, the upper condensing zone of the heat pipe being fixed to the spout in heat exchange relation therewith and the heat pipe extending downwardly inside the receptacle to position the lower evaporization zone below the product level to receive heat when the product is heated by the heater means.

3. A pump-type dispensing apparatus according to claim 2 wherein the condensing zone of the heat pipe is brazed to the spout.

4. A pump-type dispenser for heat softenable food products comprising, a product receptacle, heater means for heating the product in the receptacle and means for controlling the heater means to heat the product in the receptacle to a predetermined product softening temperature range at which the product is heat softened to a pumpable condition, pump means detachable from the receptacle and including a pump body extending downwardly in the receptacle to receive product and a dispensing spout external of the receptacle for delivering product, a closed heat pipe containing a vaporizable heat transfer fluid having an upper condensation zone in heat exchange relation with at least a portion of the spout and a lower evaporation zone arranged to receive heat from said heater means, the type and charge of vaporizable heat transfer fluid in the closed heat pipe being selected such that, at least at the lower portion of said predetermined product softening temperature range, a portion of the heat transfer fluid is in the liquid state and a portion in the vapor state whereby, when the lower evaporization zone of the heat pipe receives heat from the heater means, some of the liquid heat transfer fluid in the lower evaporization zone is vaporized and the vapors rise and condense in the upper condensation zone to heat the spout when the spout temperature is below temperature of the evaporization zone, a cover for the receptacle attached to the pump for supporting the pump in the receptacle, the cover, the pump and spout being removable as a unit from the receptacle, the upper condensing zone of the heat pipe being fixed to the spout in heat exchange relation therewith and extending through the cover and downwardly inside the receptacle to position the lower evaporation zone below the product level to receive heat when the product is heated by the heater means.

5. A pump type dispensing apparatus according to claim 4 wherein the heater means is disposed below the bottom wall of the receptacle, said evaporation zone extending adjacent the bottom of the receptacle.

6. A pump-type dispenser for heat softenable food products comprising a stationary housing, a product receptacle mounted in the stationary housing, heater means for heating the product in the receptacle and means for controlling the heater means to heat the product in the receptacle to a predetermined product softening temperature range at which the product is heat softened to a pumpable condition, pump means detachable from the receptacle and including a pump body extending downwardly in the receptacle to receive product therefrom and a dispensing spout external of the receptacle for delivering product therefrom, a closed heat pipe containing a vaporizable heat transfer fluid and having an upper condensation zone fixed to the spout in heat exchange relation with at least a portion of the spout, the heat pipe extending downwardly in the receptacle and having a lower evaporation zone disposed below the product in the receptacle, to receive heat from the product when the product is heated by said heater means, the type and charge of vaporizable heat transfer fluid in the closed heat pipe being selected such that, at least at the lower portion of said predetermined product softening temperature range, a portion of the heat transfer fluid is in the liquid state and a portion in the vapor state whereby, when the lower evaporization zone of the heat pipe receives heat from the product, some of the liquid heat transfer fluid in the lower evaporization zone is vaporized and the vapors rise and condense in the upper condensing zone to heat the spout when the spout temperature is below temperature of the evaporization zone.

7. A pump-type dispensing apparatus according to claim 6 including a cover for the receptacle attached to the pump for supporting the pump in the receptacle, the cover and pump and spout being removable as a unit from the receptacle, the heat pipe extending downwardly through an opening in the cover into the receptacle.

* * * * *